US009055813B2

(12) United States Patent
Telthörster et al.

(10) Patent No.: US 9,055,813 B2
(45) Date of Patent: Jun. 16, 2015

(54) PULL-DOWN SHELF FOR FURNITURE

(71) Applicant: Kesseböhmer Holding e.K., Bad Essen (DE)

(72) Inventors: Dirk Telthörster, Bünde (DE); Hendrik Schmidt, Preußisch Oldendorf (DE); Hermann Buschermöhle, Bersenbrück (DE)

(73) Assignee: Kesseböhmer Holding e.K., Bad Essen (DE)

( * ) Notice: Subject to any disclaimer, the term of this patent is extended or adjusted under 35 U.S.C. 154(b) by 0 days.

(21) Appl. No.: 14/531,083

(22) Filed: Nov. 3, 2014

(65) Prior Publication Data

US 2015/0122758 A1 May 7, 2015

(30) Foreign Application Priority Data

Nov. 6, 2013 (DE) ..... 10 2013 018 498

(51) Int. Cl.

| | |
|---|---|
| ***A47B 67/02*** | (2006.01) |
| ***A47B 46/00*** | (2006.01) |
| ***E05D 11/10*** | (2006.01) |
| ***E05D 11/08*** | (2006.01) |

(52) U.S. Cl.

CPC ..... *A47B 46/005* (2013.01); *E05D 11/1021* (2013.01); *E05D 11/082* (2013.01)

(58) Field of Classification Search

CPC . A47B 46/005; E05D 11/1021; E05D 11/082
USPC ..... 211/150; 312/246–248, 266, 319.6
See application file for complete search history.

(56) References Cited

U.S. PATENT DOCUMENTS

| | | | | | |
|---|---|---|---|---|---|
| 883,305 | A | * | 3/1908 | Fetch | 312/27 |
| 2,420,015 | A | * | 5/1947 | Salsman et al. | 312/276 |
| 2,667,396 | A | * | 1/1954 | Liggett | 312/248 |
| 2,882,113 | A | * | 4/1959 | Gantner | 312/248 |
| 4,076,351 | A | * | 2/1978 | Wyant | 312/247 |
| 4,150,861 | A | * | 4/1979 | Dufrancatel | 312/266 |
| 5,026,129 | A | * | 6/1991 | Merl | 312/266 |
| 5,249,858 | A | * | 10/1993 | Nusser | 312/319.6 |
| 5,308,158 | A | * | 5/1994 | Vogelgesang et al. | 312/319.3 |
| 5,456,529 | A | * | 10/1995 | Cheung | 312/245 |
| 5,857,756 | A | * | 1/1999 | Fehre | 312/246 |
| 6,367,898 | B1 | * | 4/2002 | Jobe | 312/246 |

(Continued)

FOREIGN PATENT DOCUMENTS

| | | |
|---|---|---|
| EP | 1 820 420 A1 | 8/2007 |
| WO | 94/23612 A1 | 10/1994 |

*Primary Examiner* — Joshua J Michener
*Assistant Examiner* — Devin Barnett
(74) *Attorney, Agent, or Firm* — Gudrun E. Huckett

(57) ABSTRACT

A furniture pull-down shelf has first and second opposed lateral webs delimiting a shelf receptacle. First and second pairs of pivot levers are pivotably secured on first and second opposed furniture sidewalls and on the first and second lateral webs and define first and second four-bar linkages. The first and second four-bar linkages transfer the shelf from a stowed position inside the furniture into a lowered access position. An operating element is connected to first pivot levers of the first and second pairs of pivot levers. It extends in an initial operating position along a front side of the shelf receptacle. When pivoting the pull-down shelf into the access position, the connecting element moves from the initial operating position into a downward open operating position.

10 Claims, 10 Drawing Sheets

(56) References Cited

U.S. PATENT DOCUMENTS

| | | | | |
|---|---|---|---|---|
| 6,886,781 | B2 * | 5/2005 | Lau et al. | 244/118.1 |
| 8,403,262 | B2 * | 3/2013 | Bartels et al. | 244/118.5 |
| 8,414,093 | B2 * | 4/2013 | Moran | 312/248 |
| 8,777,338 | B2 * | 7/2014 | Bunch | 312/248 |
| 2010/0007253 | A1 * | 1/2010 | Ryerson | 312/247 |
| 2010/0308615 | A1 * | 12/2010 | Miles | 296/37.8 |
| 2013/0206903 | A1 * | 8/2013 | Savian et al. | 244/118.1 |
| 2014/0152159 | A1 * | 6/2014 | Schneider et al. | 312/248 |
| 2014/0197720 | A1 * | 7/2014 | Sorbara et al. | 312/247 |

* cited by examiner

PULL-DOWN SHELF FOR FURNITURE

BACKGROUND OF THE INVENTION

The invention concerns a pull-down shelf for a piece of furniture, in particular a pull-down shelf for a kitchen wall cabinet, comprising a pair of pivot levers that are pivotably secured, respectively, on oppositely positioned sidewalls of the piece of furniture as well as on oppositely positioned lateral webs of the pull-down shelf that laterally delimit a shelf receptacle and that form in pairs, respectively, a four-bar linkage for transferring the pull-down shelf from an initial stowed position located within the interior of the cabinet into a lowered access position.

Pivotable shelves for furniture are known. Conventionally, they are known in particular for upright cabinets and can be pivoted about vertical axes into a position in which objects that are positioned on a shelf receptacle can be more easily removed in the open position of the pivotable shelf. However, it is often also required, for example, in kitchen wall cabinets, to provide pull-down shelves in order to make accessible objects stored on the shelves in particular for operating persons of a short body height. For this purpose, for furniture for storage of clothes, it is known to provide clothes rods at different heights wherein a handle is provided at the upper rod. The clothes rod is attached to lateral pivot levers, that, for example, may be embodied as a four-bar linkage and are attached, in turn, to lateral walls of the body of the cabinet. Such a configuration is however not possible for kitchen wall cabinets because a handle cannot be accommodated. Despite of this, in particular in case of kitchen wall cabinets with dimensions that often reach up to the ceiling, it is desirable to provide better access to objects that are stored in upper areas of these cabinets.

It is the object of the present invention to provide a pull-down shelf for a piece of furniture that is also suitable for kitchen wall cabinets and that makes it possible to provide better access to objects that are stored in upper areas of the kitchen wall cabinet.

SUMMARY OF THE INVENTION

As a solution to this object, the pull-down shelf for a piece of furniture of the aforementioned kind is characterized in that a pivot lever of a pivot lever pair and a correlated pivot lever of the other pivot lever pair are connected to each other by means of an operating element which is extending in its initial operating position along a side of the shelf receptacle that is facing the operating person during pivoting of the shelf and, upon pivoting of the shelf into its open position, is transferable from its initial operating position into a downwardly pivoted open operating position.

In this way, a pull-down shelf is made available that is highly suitable to be mounted in kitchen wall cabinets, wherein the operating element extends across the entire width of the shelf, and thus also of the shelf receptacle, and can be gripped by an operating person in order to transfer the shelf from its initial stowed position located within the interior of the cabinet into its downwardly pivoted open position of access. The operating element can be automatically pivoted during the course of this downward pivot movement of the shelf into its open operating position that is also downwardly pivoted. The operating element can be arranged such that in its initial operating position it is positioned, for example, at a vertical spacing to a bottom of the shelf receptacle and, in this way, presents in the manner of a guardrail a stored goods securing element for stored kitchen utensils. Moreover, it can couple the movement of the pivot levers to each other so that it also forms a synchronizing component.

By means of a preferred special kind of the pivot levers, connected to each other by the operating element, of the respective pivot lever pairs that form the four-bar linkage, for example, in that bent ends of the pivot lever pairs correlated with each other project past the shelf receptacle and thus the lateral webs of the shelf, the operating element can be arranged and embodied such that, in the initial operating position, it forms the stored goods boundary and thus delimits a front-side receiving opening of the shelf receptacle toward the front, i.e., toward the open side of the pull-down shelf, and, in its downwardly pivoted open position, enables free access to the shelf receptacle.

In the open position, the operating element is preferably positioned in a plane below the bottom of the shelf receptacle. This operating element, for example, in the form of the guardrail or guard rod, additionally stiffens the shelf as a whole. On this operating element, a handle element can be attached that pivots downwardly together with the operating element into the open position. This handle element can be designed like a handle bracket that, in the initial operating position, i.e., in the position in which the shelf is located within the interior of the cabinet, extends from the operating element, i.e., the guard rod which is extending at a vertical spacing relative to the shelf bottom, downward to the shelf bottom so that it can also form a stored goods boundary. It can be gripped by an operating person safely and ergonomically in order to then be pivoted downwardly, together with the operating element and the shelf, into a position in which it is extending below the shelf receptacle bottom. For assisting this, spring elements, for example, gas pressure springs, can be used that are designed to be adjustable in order to assist in or dampen the corresponding downward and/or upward movement for the operating person. Also, it is possible to provide, for example, end stops of an elastomeric material.

BRIEF DESCRIPTION OF THE DRAWINGS

Further embodiments of the invention and further advantages result from the additional dependent claims, the following description, and the drawing.

In the drawing, principally coinciding parts are provided with identical reference numbers.

DESCRIPTION OF PREFERRED EMBODIMENTS

Figure 1:
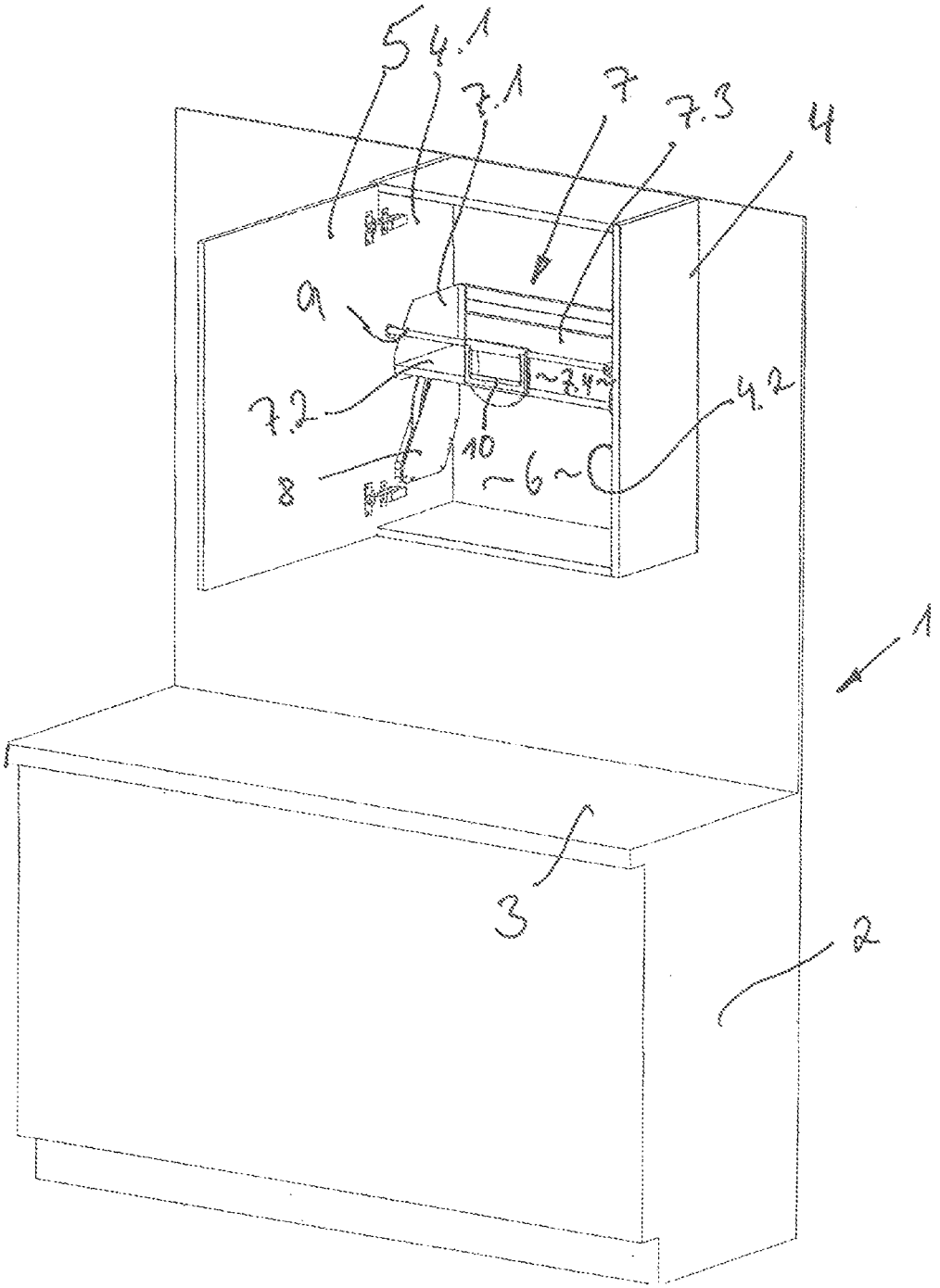
FIG. 1 shows an embodiment of a kitchen furniture assembly with a kitchen wall cabinet with an embodiment of a pull-down shelf according to the invention with open kitchen wall cabinet door.

Generally, 1 indicates in FIG. 1 a detail of a kitchen furniture assembly with a floor cabinet 2, a worktop 3 as well as a kitchen wall cabinet 4 with a door 5 that is pivotable into an open position, and a pull-down shelf, generally identified by 7 and arranged in the cabinet interior in the initial stowed position, that comprises lateral webs 7.1, a shelf bottom 7.2, as well as a shelf receptacle generally identified by 7.3 with a shelf front side 7.4 which, when the cabinet door 5 is open, faces an operating person and through which the shelf 7 can be filled with objects in that they are deposited from the front, i.e., through the shelf front side 7.4, on the shelf bottom 7.2 or instead are inserted from above into the shelf receptacle 7.3 for placement on the shelf bottom 7.2. The shelf 7, in a way to be described in the following in more detail, is to be fastened and covered by means of spacer frames 8 on the sidewalls 4.1 and 4.2. The pull-down shelf 7 has an operating element 9 in the form of a guard rod, which will be explained in more detail in the following, as well as a handle 10 as a gripping element attached to the guard rod 9.

Figure 2:
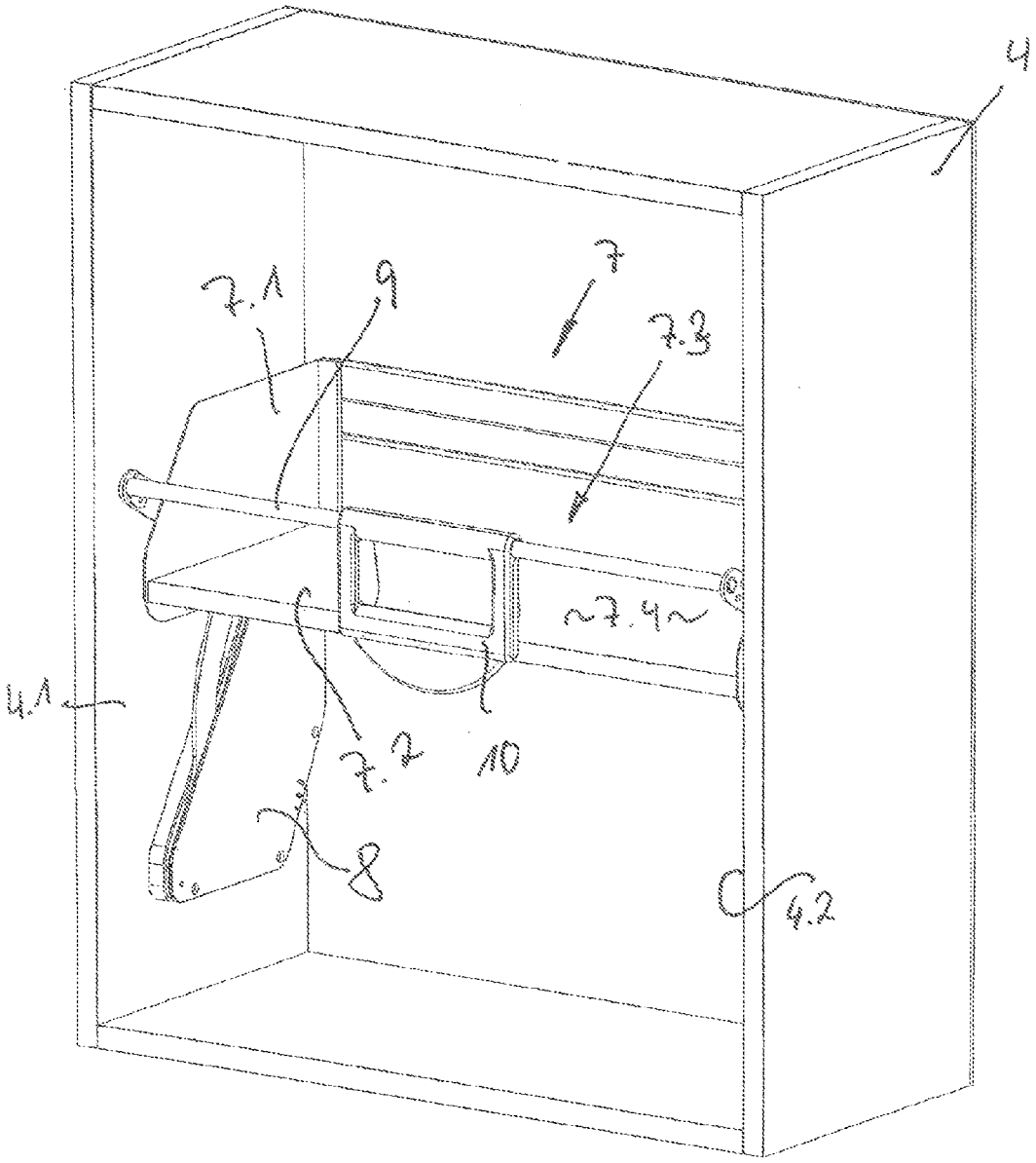
FIG. 2 shows an enlarged perspective illustration of the kitchen wall cabinet (without door) with pull-down shelf in the interior of the kitchen cabinet (initial stowed position).

In FIG. 2, the pull-down shelf 7 is shown further enlarged in a perspective view in its initial stowed position in which it is located in the interior of the kitchen wall cabinet 4 and the operating element in the form of the guard rod 9 is extending at a vertical spacing relative to the shelf bottom 7.2 and therefore provides a stored goods securing element as does the handle bracket 10 which is extending substantially vertically downwardly.

Figure 3:
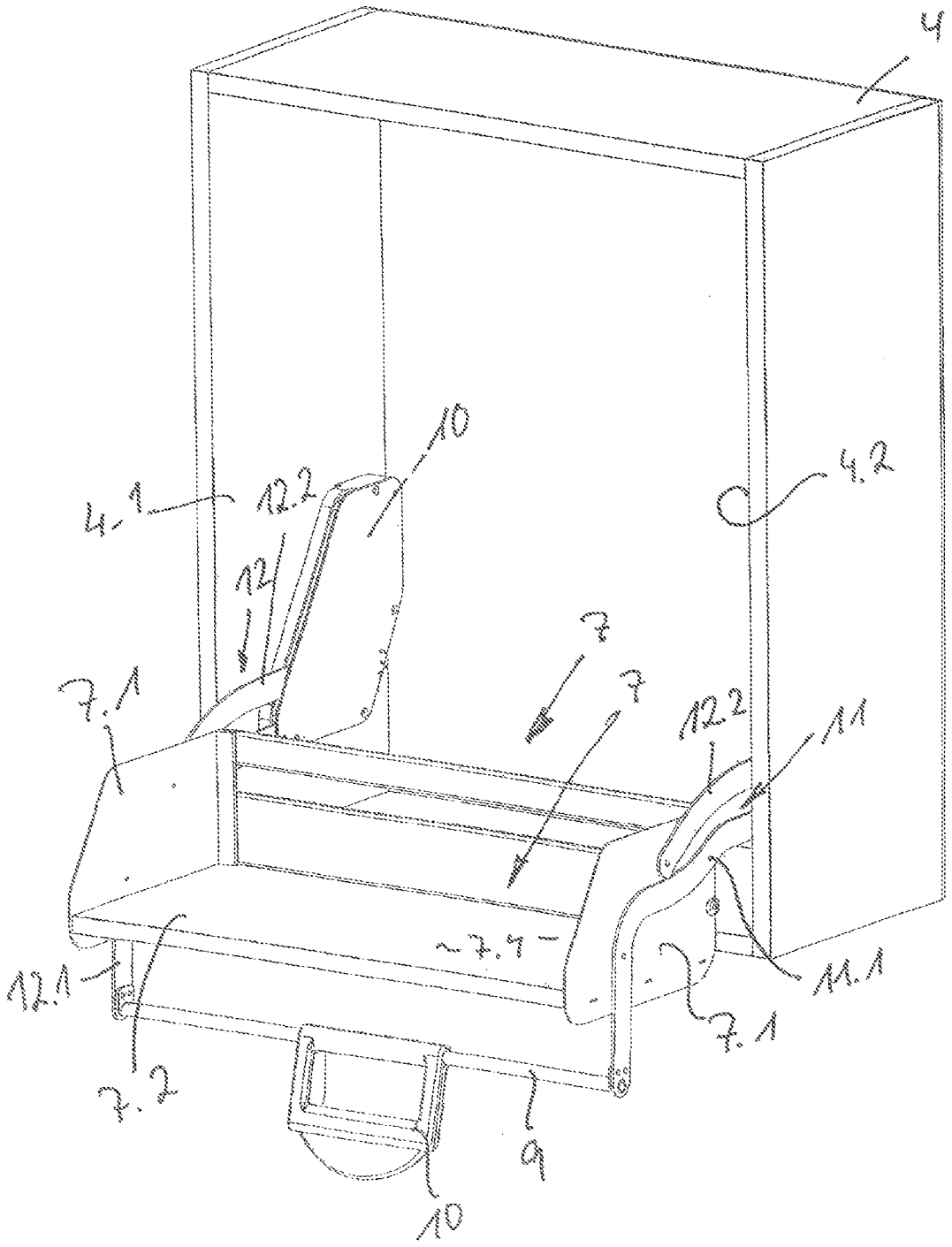
FIG. 3 is an illustration of the pull-down shelf analog to FIG. 2 in its open position lowered from the kitchen wall cabinet.

In FIG. 3, an illustration analog to the illustration of FIG. 2 is shown in which the shelf 7 has been moved into a lowered open position wherein during this downwardly oriented pivot movement of the shelf 7 the operating element 9 has also been automatically lowered by means of the pivot lever pairs 11 and 12 so that the operating element 9 is also in its open operating position in which it is arranged below the shelf bottom 7.2, as is the handle bracket 10, so that the receiving opening 7.4 of the shelf 7 is freely accessible.

Figure 4:
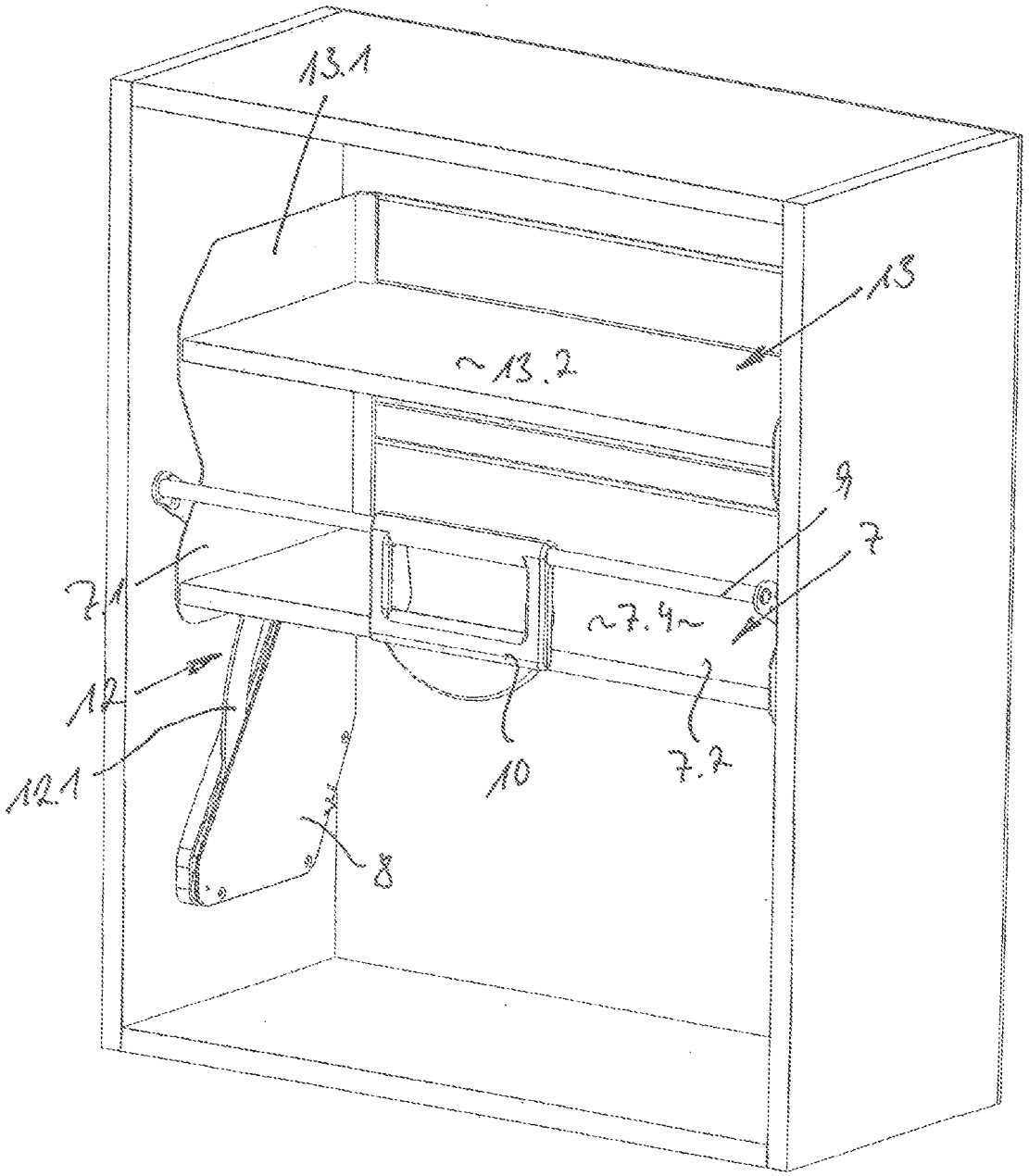
FIG. 4 is an illustration analog to FIG. 2 of a pull-down shelf in its initial stowed position in the kitchen wall cabinet with a further shelf receptacle.

FIG. 4 shows in an illustration analog to the embodiment according to FIG. 2 a further embodiment in which above the first shelf 7 with the shelf bottom 7.2 a further shelf 13 with a shelf bottom 13.2 and lateral shelf webs 13.1 is provided, i.e., a double-deck pull-down shelf 7, wherein the operating element 9 is however to be pivoted up and down also by means of the handle bracket 10.

Figure 5:
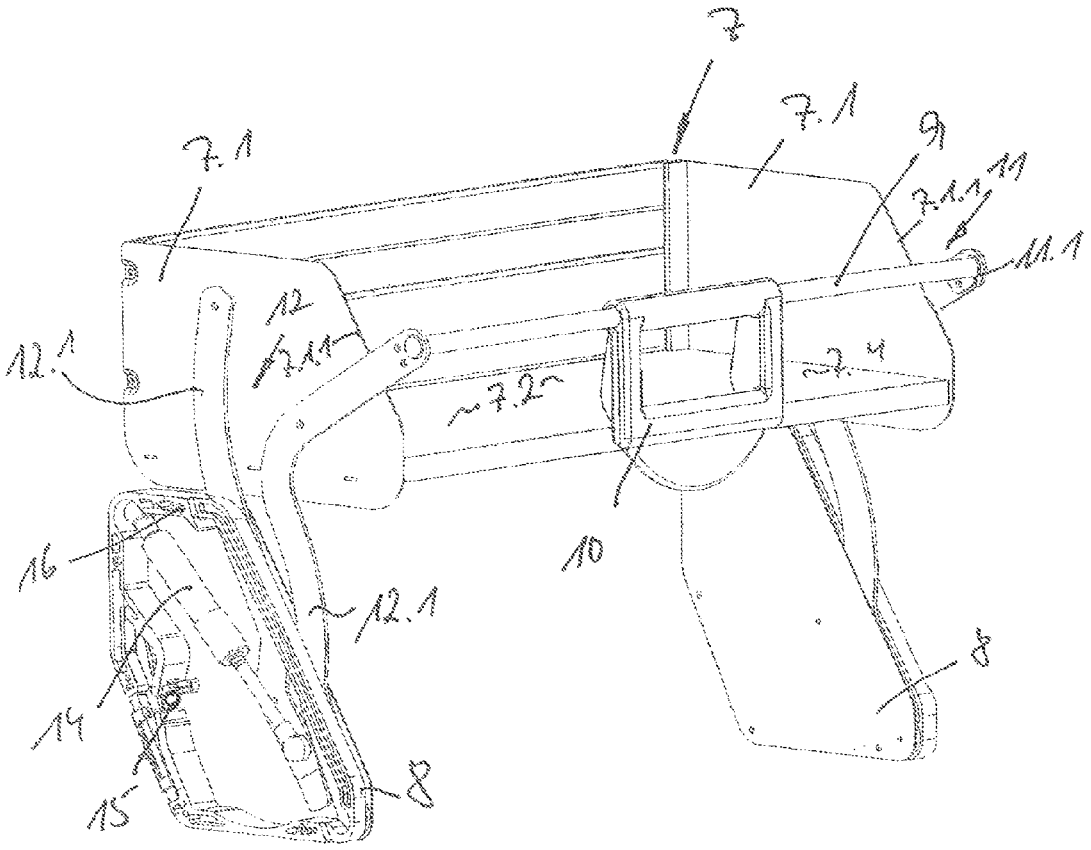
FIG. 5 is an embodiment of a pull-down shelf according to the invention in perspective illustration in the initial operating position of the operating element with lateral frames provided relative to the sidewalls of a cabinet.

FIG. 5 shows in a perspective illustration the shelf 7 with its shelf bottom 7.2, the lateral webs 7.1 of the shelf 7 as well as the operating element 9 in the form of a guard rod and the handle 10 in the initial stowed position in accordance with FIG. 2. The respective pivot lever pairs 11 and 12 each comprise pivot levers 11.1 and 11.2 as well as 12.1 and 12.2 that each individually by their pivot connections at the lateral webs 7.1 of the shelf and their pivot connections at the sidewalls 4.1 and 4.2 of a cabinet 4 by means of the spacer frame 8 form a four-bar linkage. For assisting the upward pivot movement and downward pivot movement of the shelf 7, gas pressure springs 14 can be provided that can be configured to be adjustable. Also, it is possible to provide elastomeric end stops 15 and 16 for assuming respectively the initial stowed position and the access position where one of the pivot levers is in contact, respectively. The pivot levers 11.1 and 12.1 are bent so that they project past the front side and therefore past the forward edges 7.1.1 of the shelf 7 even in the initial stowed position of the pull-down shelf 7 so that the operating element 9 in the form of the guard rod is also in a position in front of this front edge 7.1.1 of the respective lateral webs 7.1 of the shelf and the grip bracket 10 is extending in downward direction down to the front edge of the bottom part 7.2 of the shelf.

Figure 6:
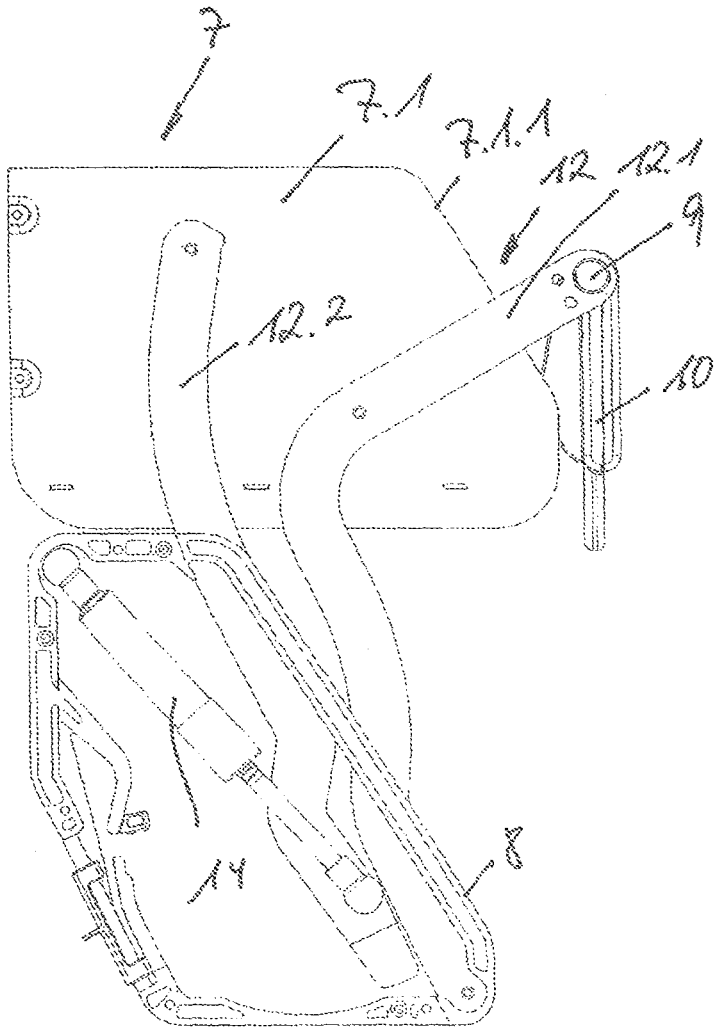
FIG. 6 is a side view of the embodiment of FIG. 5.
Figure 7:
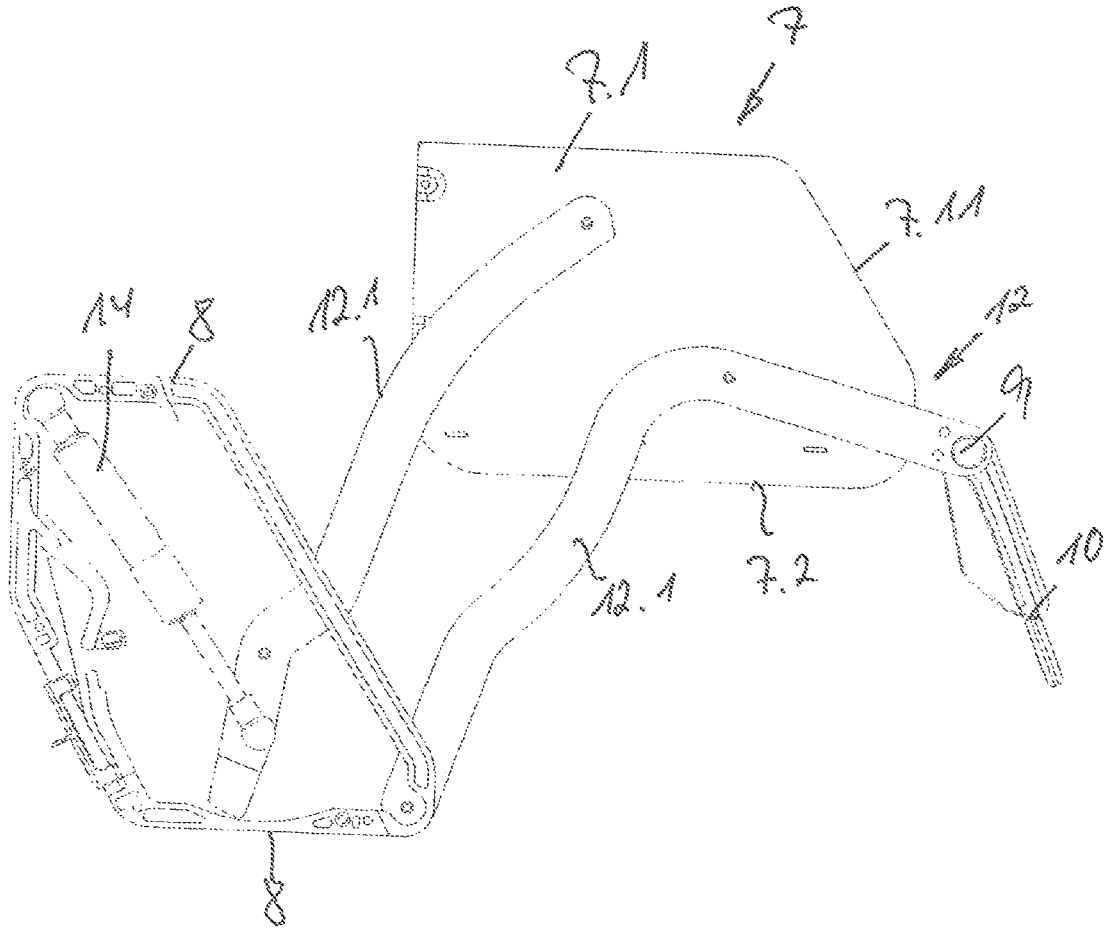
FIG. 7 is an illustration (side view) analog to FIG. 6 during the downwardly oriented pivot movement.
Figure 8:
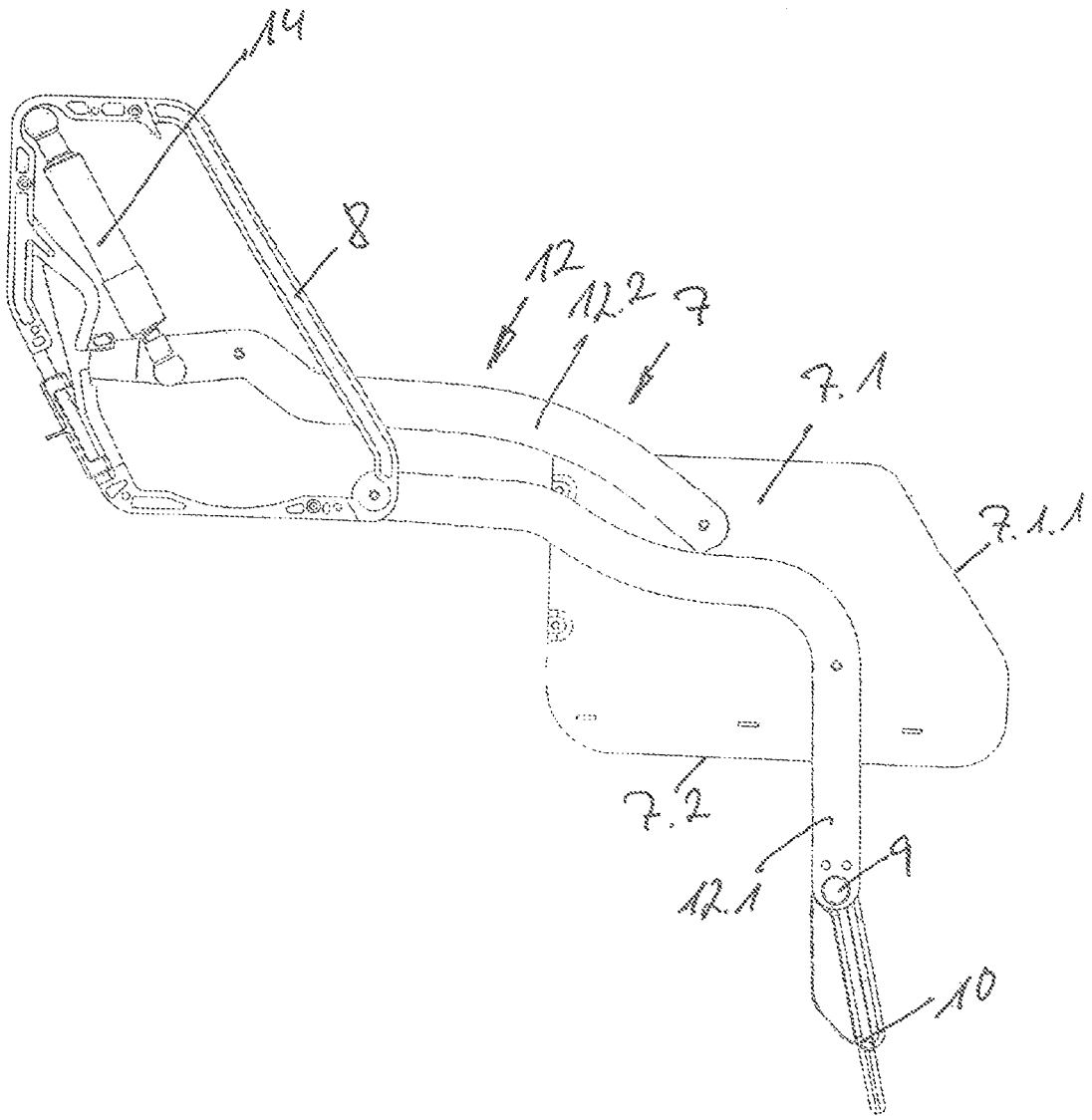
FIG. 8 is an illustration analog to FIGS. 6 and 7 of the embodiment (side view) in the lowered open position of the shelf and of the operating element.

FIG. 6 shows in greater detail in a side view the elements of the illustration of FIG. 5. FIG. 7 shows the position of the shelf 7 in an intermediate position during the course of a downwardly oriented pivot movement. The handle bracket 10 has been pulled by an operating person wherein the handle bracket is connected pivotably with the operating element 9, i.e., the guard rod 9, so that the handle bracket 10 assumes the respective optimal angular position that is ergonomic to the operating person. The operating element 9 is to be moved into a relative pivot position relative to the shelf 7 in which it is pivoted farther downwardly in the sense of the downward movement into a position as can be seen in FIG. 8, so that the operating element 9 together with the end of the bent area of the lever 12.1 as well as the handle bracket 10 is located below the bottom 7.2 of the shelf 7.

Figure 9:
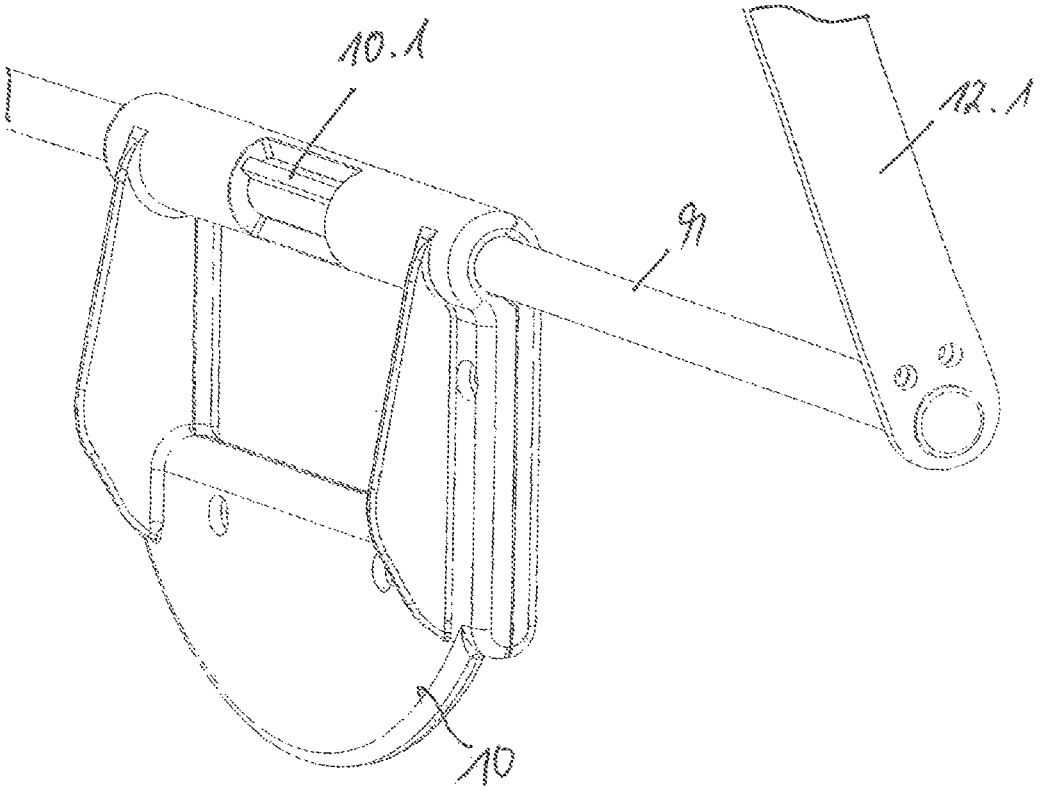
FIG. 9 shows in a perspective enlarged view a partial view of the operating element with an embodiment of a handle bracket.
Figure 10:
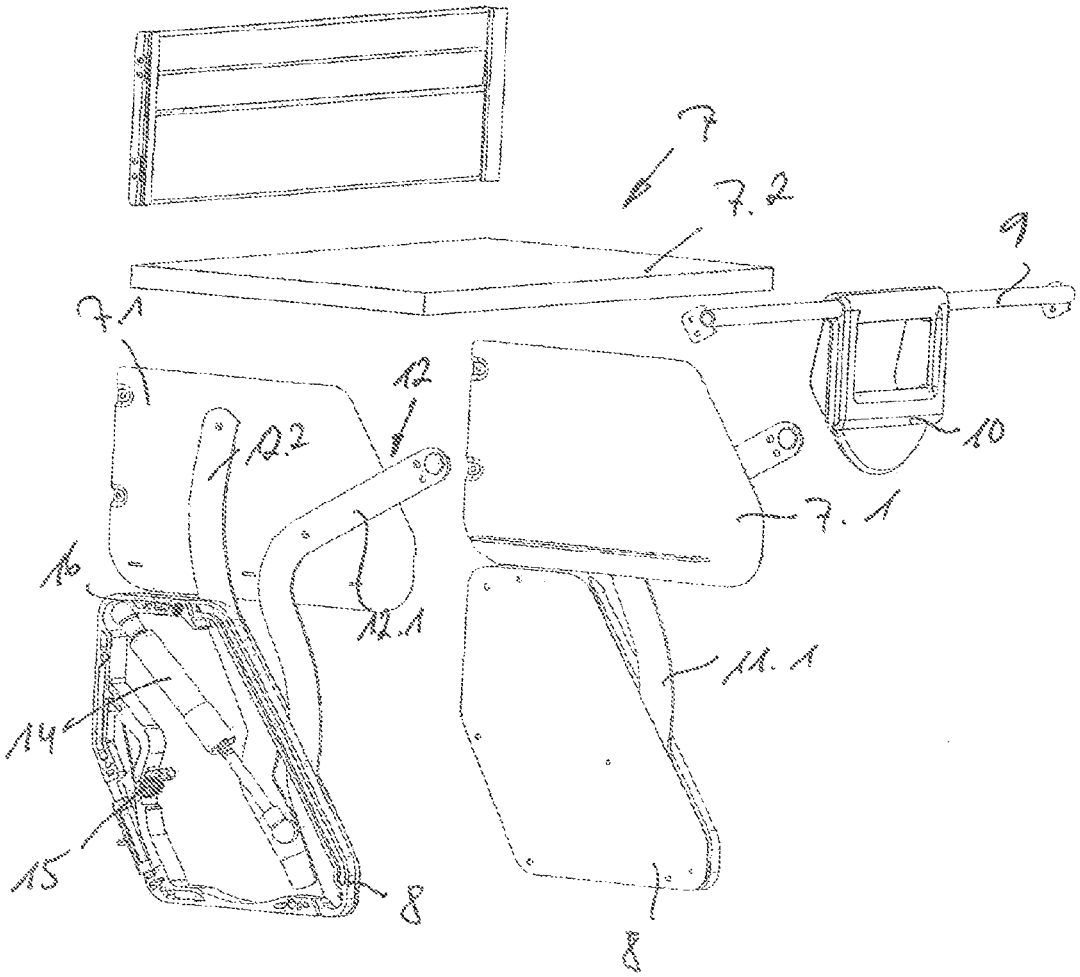
FIG. 10 is a detail illustration (perspective) of the embodiment according to FIG. 5.

FIG. 9 illustrates again the bent end area of the pivot lever 12, the operating element 9 in the form of the guard rod, as well as the handle bracket 10 that is secured at the operating element 9 to be pivotable up to the stops 10.1. FIG. 10 shows again the individual parts of the embodiment as explained in connection with FIGS. 1 through 9.

The specification incorporates by reference the entire disclosure of German priority document 10 2013 018 498.3 having a filing date of Nov. 6, 2013.

While specific embodiments of the invention have been shown and described in detail to illustrate the inventive principles, it will be understood that the invention may be embodied otherwise without departing from such principles.

What is claimed is:

1. A pull-down shelf for a piece of furniture, the pull-down shelf comprising:

a generally planar bottom, a back surface, an open front side, a first lateral web and a second lateral web that are oppositely positioned relative to each other, the first lateral web and the second lateral web are each perpendicular to the bottom; the bottom, the back surface and the first and second lateral webs define a receptacle of the pull-down shelf wherein items can be stored within the receptacle;

a first pair of pivot levers pivotably secured on a first sidewall of a piece of furniture at a first end of the first pair of pivot levers and pivotably secured on the first lateral web at a second end of the first pair of pivot levers, first pair of pivot levers define a first four-bar linkage;

a second pair of pivot levers pivotably secured on a second sidewall of the piece of furniture at a first end of the second pair of pivot levers and pivotably secured on the second lateral web at a second end of the first pair of pivot levers, the second pair of pivot levers define a second four-bar linkage;

the first and second four-bar linkages configured to transfer the pull-down shelf from an initial stowed position located within an interior of the piece of furniture into a lowered access position located outside the interior of the piece of furniture;

an operating element connected to a first pivot lever of the first pair of pivot levers and connected to a first pivot lever of the second pair of pivot levers;

the operating element configured to be transferred from an initial operating position wherein the pull-down shelf is located in the initial stowed position into a downwardly pivoted open operating position when pivoting the pull-down shelf into the lowered access position;

the operating element extends along the front side of the shelf receptacle above the bottom of the pull-down shelf in the initial stowed position in order to provide a barrier to prevent items from falling off the pull-down shelf along the open front side; and the operating element is located below the bottom of the pull-down shelf in the lowered access position.

2. The pull-down shelf according to claim 1, wherein the operating element is a synchronizing component providing a movement coupling action acting on the first and second pairs of pivot levers.

3. The pull-down shelf according to claim 1, wherein the operating element is a grip rod.

4. The pull-down shelf according to claim 1, wherein the operating element comprises a gripping bracket.

5. The pull-down shelf according to claim 1, wherein the first pivot levers of the first and second pairs of pivot levers connected to each other by the operating element are bent and comprise a bent pivot lever end area, respectively, that projects past the first shelf receptacle at the front side.

6. The pull-down shelf according to claim 1, further comprising at least one second shelf receptacle positioned above or below the first shelf receptacle.

7. The pull-down shelf according to claim 1, further comprising a spring, wherein the first shelf receptacle is pivotable with the first and second pairs of pivot levers against the force of the spring.

8. The pull-down shelf according to claim 7, wherein the spring comprises an adjustable spring force.

9. The pull-down shelf according to claim 1, further comprising elastomeric stops, wherein the pull-down shelf is pivotable against the elastomeric stops defining the access position and the initial stowed position, respectively.

10. The pull-down shelf according to claim 1, wherein the pull-down shelf is configured to be locked in the access position.

* * * * *